US006699078B2

(12) United States Patent
Quadir

(10) Patent No.: US 6,699,078 B2
(45) Date of Patent: Mar. 2, 2004

(54) CONNECTOR BLOCK HAVING AT LEAST ONE PROTRUSION, FOR A TERMINAL ASSEMBLY

(75) Inventor: Tariq Quadir, West Chester, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/032,374

(22) Filed: Dec. 21, 2001

(65) Prior Publication Data

US 2003/0119373 A1 Jun. 26, 2003

(51) Int. Cl.[7] ..... H01R 13/04

(52) U.S. Cl. ..... 439/693; 439/685; 439/587; 439/272; 439/733.1

(58) Field of Search ..... 439/685, 693, 439/586, 587, 272, 278, 281, 283, 733.1

(56) References Cited

U.S. PATENT DOCUMENTS

| | | | | | |
|---|---|---|---|---|---|
| 2,728,060 | A | | 12/1955 | Doag | 339/191 |
| 3,522,575 | A | * | 8/1970 | Watson et al. | 439/281 |
| 3,569,908 | A | | 3/1971 | Appleton | 339/91 |
| 3,586,910 | A | | 6/1971 | Sauber | |
| 3,649,839 | A | | 3/1972 | Appleton | 250/215 |
| 3,714,618 | A | | 1/1973 | Appleton | 339/198 |
| 3,716,821 | A | | 2/1973 | Appleton | 339/205 |
| 3,721,948 | A | | 3/1973 | Brandt | 339/176 |
| 3,753,098 | A | | 8/1973 | Sambhu et al. | 324/65 |
| 3,753,210 | A | | 8/1973 | Speth et al. | 339/65 |
| 3,780,238 | A | | 12/1973 | Brant et al. | 200/11 |
| 3,801,131 | A | | 4/1974 | Appleton | 285/159 |
| 3,850,496 | A | | 11/1974 | Hague | 339/64 |
| 3,983,428 | A | | 9/1976 | Bitsch et al. | 310/71 |
| 4,033,663 | A | | 7/1977 | McCardell | 439/545 |
| 4,059,325 | A | * | 11/1977 | Diminnie et al. | 439/519 |
| 4,085,989 | A | | 4/1978 | McCardell | 439/595 |
| 4,403,885 | A | | 9/1983 | Babb | 403/317 |
| 4,523,798 | A | | 6/1985 | Barrows et al. | 439/685 |
| 4,611,138 | A | | 9/1986 | Kindig et al. | 310/71 |
| 4,748,531 | A | | 5/1988 | Ortiz | 361/24 |
| 4,966,559 | A | * | 10/1990 | Wisner | 439/566 |
| 5,129,843 | A | * | 7/1992 | Bowsky et al. | 439/685 |
| 5,131,858 | A | * | 7/1992 | Heimbrock | 439/181 |
| 5,167,518 | A | * | 12/1992 | Deacon | 439/188 |
| 5,336,105 | A | | 8/1994 | Wisner | 439/367 |
| 5,580,282 | A | * | 12/1996 | Paterek | 439/685 |
| 5,584,716 | A | | 12/1996 | Bergman | 439/282 |
| 5,616,975 | A | | 4/1997 | May et al. | 310/89 |
| 5,664,959 | A | | 9/1997 | Duell et al. | 439/278 |
| 5,894,179 | A | | 4/1999 | Filla et al. | 310/71 |
| 6,305,989 | B1 | * | 10/2001 | Quadir | 439/685 |

OTHER PUBLICATIONS

International Search Report for PCT/US02/41291, Issued Apr. 3, 2003, 3–pages.

* cited by examiner

*Primary Examiner*—Truc Nguyen
(74) *Attorney, Agent, or Firm*—Howrey Simon Arnold & White LLP

(57) ABSTRACT

A connector block adaptable to engage with a terminal assembly of a hermetically sealed compressor, including a circular substantially flat surface that has a plurality of holes adaptable to receive the electrical conductor pins mounted inside the terminal assembly when the connector block is engaged with the terminal assembly. At least partially surrounding the circumference of at least one of the holes is a protrusion located on the substantially flat surface. The circular substantially flat surface defines a connector lip erected around its perimeter. This connector lip is designed to cover the open end of the cap of the terminal assembly and to surround the electrical conductor pins so as to minimize possible electrical arcing. The connector lip is fisher designed to seal the open end of the cap of the terminal assembly such that no particles from the hermetically sealed compressor could enter into the cap of the terminal assembly.

36 Claims, 8 Drawing Sheets

CONNECTOR BLOCK HAVING AT LEAST ONE PROTRUSION, FOR A TERMINAL ASSEMBLY

BACKGROUND OF THE INVENTION

1. Field of the Invention

The present invention relates generally to connector blocks for terminal assemblies, and more particularly, to connector blocks for electrical conductor pins of hermetic terminal assemblies.

2. Description of Related Art

A hermetically sealed compressor, typically used for air conditioning or refrigeration applications, has a sealed metal chamber. A motor and a compressor are mounted within the chamber. The electrical power to the motor is connected through the chamber and a terminal assembly.

The terminal assembly typically takes the form of a cup-shaped metal support having three holes, sometimes referred to as the terminal cap. An electrical conductor pin is mounted in each of the three holes and is mechanically supported in the cup-shaped element by fused glass beads that are bonded to both the pin and the metallic element. The fused glass beads and the metal are connected to form a glass-to-metal seal.

Within the compressor, the three leads to the motor are terminated in connector clips each having a receptacle that slides down upon the pin. The three connector clips are mounted in a connector block having three parallel passageways through which the connector clips and leads pass. The connector clips are equiangularly arrayed in a position to be pushed upon the three pins of the terminal assembly, thereby forming the electrical connection between the motor and the electrical conductor pins.

During the operation of the compressor, metallic or degraded oil particles in the system are attracted to the surface of the fused glass beads. The buildup of such particles on the surface of the fused glass beads can establish an electrical conductive path resulting in a short circuit and/or a thermal failure. Other contaminants in the system, such as moisture and acidic components (e.g., halogen acids resulting from a partial decomposition of the halogenated hydrocarbon refrigerant), may also directly attack the glass surfaces causing or contributing to an electrical breakdown. Another cause of electrical breakdown of the terminal assembly pertains to compressor motor failure. As a result of the high temperatures during the compressor motor failure, carbon may be generated. Consequently, a mixture of the generated carbon may be deposited on the inside portion of the hermetic terminal assembly and form a conductive path between the terminal electrical conductor pins and ground, which may lead to arcing.

The present invention, which relates to connector block modifications, serves to minimize contaminants leakage in ambient surroundings and to minimize undesirable arcing, which, if combined with leakage contamination, could lead to destructive consequences.

Connector blocks for connecting lead wire ends to electrical conductor pins of a terminal assembly are known in the electrical connector art. For example, U.S. Pat. No. 4,059,325, issued to Edward A. Diminnie et al. on Nov. 22, 1977, proposes a flat shield facing the peripheral edge of a terminal cup sidewall. Another U.S. Pat. No. 4,966,559, issued to Ronald R. Wisner on Oct. 30, 1990, proposes a pin surrounding cylindrical side wall portion extending from a connector block face to fit snugly in interface contact within the open end of the terminal body member side wall. Yet another U.S. Pat. No. 5,129,843, issued to Benjamin Bowsky et al. on Jul. 14, 1992 and U.S. Pat. No. 5,131,858, issued to Henry H. Heimbrock on Jul. 21, 1992, both propose over-surface wall shield members in surrounding relation to conductor pin end portions. Another U.S. Pat. No. 5,580,282, issued to F. Dieter Paterek on Dec. 3, 1996, proposes an over-surface wall shield assembly of O-ring sealing members, extending from the outer face of a connector block configured to fit inside the terminal assembly and spacedly surround both the exposed pin assembly and pin insulation to provide tortuous passageways therebetween.

From the above patents, it can be seen that various attempts have been made in providing structure that shields conductor pins, as well as their insulating materials, from contaminants to minimize undesirable conductive arcing paths. For the most part, these past structures have been comparatively complex and costly in both manufacture and assembly and have fallen short of the results they have sought to achieve. They further present structural assembly, disassembly and wear problems.

The present invention, recognizing the limitations of past structures, provides a unique connector block for a terminal assembly which is straightforward, economical to manufacture, and easy to assemble and disassemble.

SUMMARY OF THE INVENTION

According to one exemplary aspect of the present invention, an apparatus and method are provided for a connector block adaptable to engage with a terminal assembly of a hermetically sealed compressor. The terminal assembly defines a cap and a number of electrical conductor pins extending from inside the cap. The connector block defines a substantially flat surface that has a number of holes adaptable to receive the electrical conductor pins. Around one or more of these holes there is employed a protrusion that at least partially surrounds the circumference of the hole. The substantially flat surface may have a circular construction. The substantially flat surface defines a connector lip erected around its perimeter. This connector lip is designed to cover the open-end portion of the cap of the terminal assembly and to surround the electrical conductor pins so as to minimize possible electrical arcing.

In another exemplary aspect of the present invention, the connector lip is further designed to seal the open-end portion of the cap of the terminal assembly such that the amount of particles from the hermetically sealed compressor that can enter into the cap of the terminal assembly is greatly minimized.

In yet another exemplary aspect of the present invention, the connector lip has an inside diameter that is slightly larger than the outside diameter of the open-end portion of the cap.

In a further exemplary aspect of the present invention, the connector lip has an inside diameter of approximately 1.322 inches and a height of 0.05 inch. In a still further exemplary aspect of the present invention, the connector lip and the connector block is one piece.

In another exemplary aspect of the present invention, at least one protrusion is further designed to surround at least a portion of an electrical conductor pin. In a still further exemplary aspect of the present invention, the protrusion and the connector block are one piece.

The present invention has many advantages over the prior art. For example, by covering the entire periphery of the terminal cap's open end, the amount of contaminants from the compressor chamber that is likely to enter the terminal cap may be significantly reduced. Moreover, the employment of one or more protrusions to at least partially surround the circumference of one or more of the holes of the connector block may further shield the electrical connector pins from contaminants and further reduce the possibility of damaging arcing. In fact, none of the prior art of reference discloses such protection for the terminal cap. At most, the prior art may propose a connector block that seals the terminal cap with O-rings attached to the outer face of the connector block. Nevertheless, the terminal cap's open end would still be left uncovered, rendering it vulnerable to the possibility of accumulation of contaminants. In addition, the connector block of the present invention can be manufactured more easily at much lower cost than the prior art's connector block that incorporates O-ring sealing members on its outer face.

Thus, a connector block in accordance with the present invention, which covers the entire periphery of the terminal cap's open end and employs at least one protrusion that at least partially surrounds the circumference of at least one of the holes of the connector block, has apparent advantages over the prior art.

BRIEF DESCRIPTION OF THE DRAWINGS

The features and advantages of the present invention will be best appreciated upon reference to the following detailed description and the accompanying drawings, in which.

Figure 1:
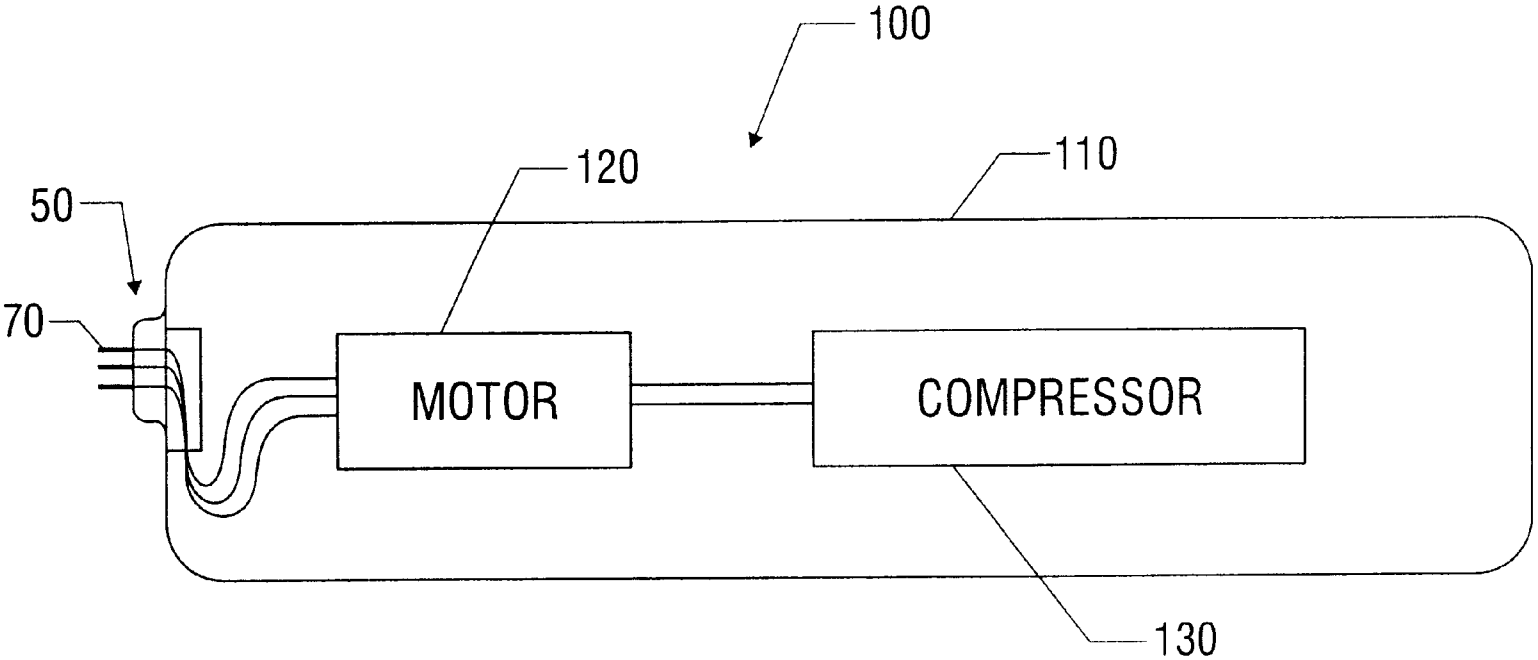
FIG. 1 is a diagrammatic side view, partly in section, of the interior of a hermetically sealed compressor.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 3A:
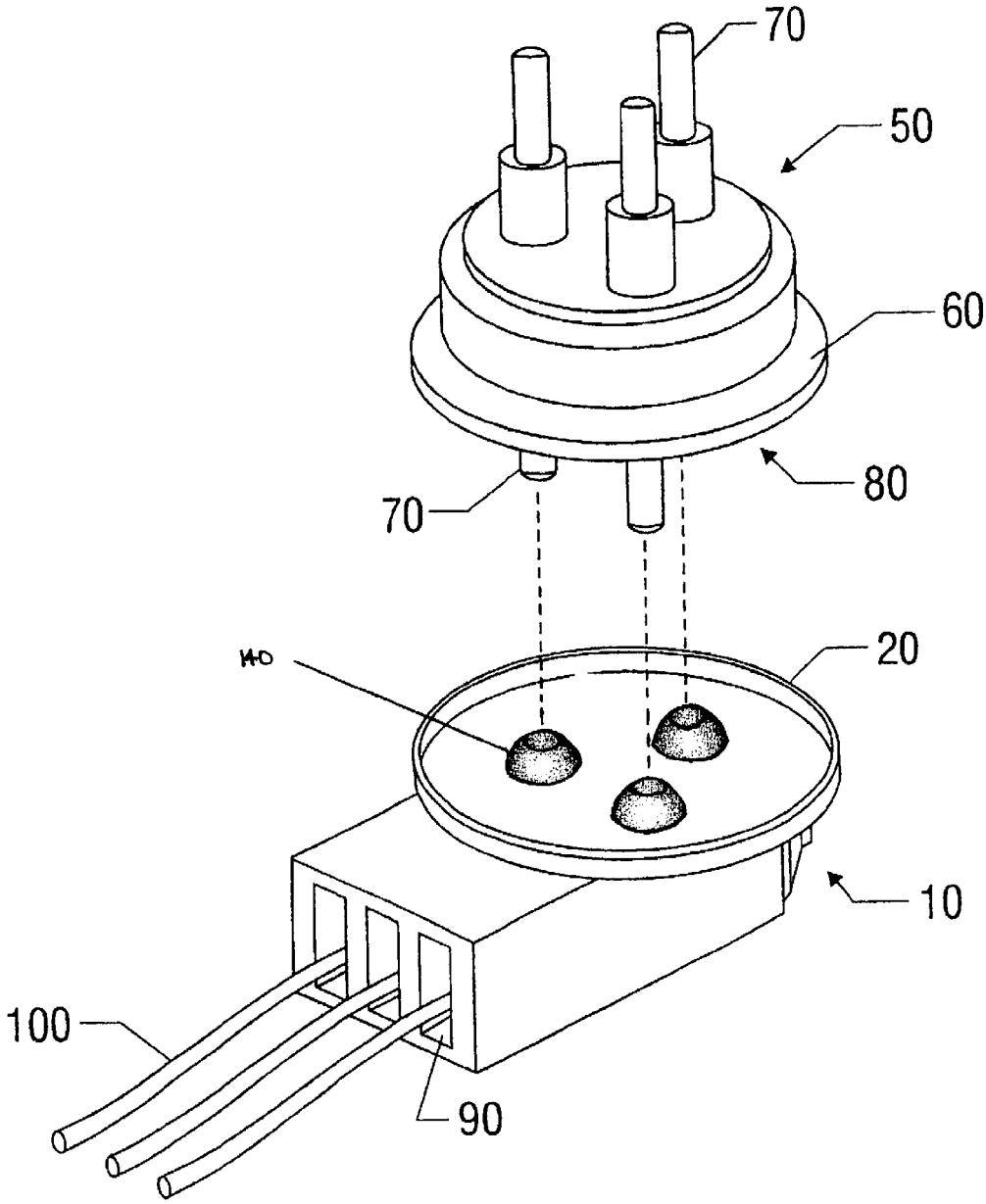
FIG. 3A and FIG. 3B are rear perspective views of the connector blocks illustrated in FIG. 2A and FIG. 2B, respectively, adapted to couple with a terminal assembly.
Figure 3B:
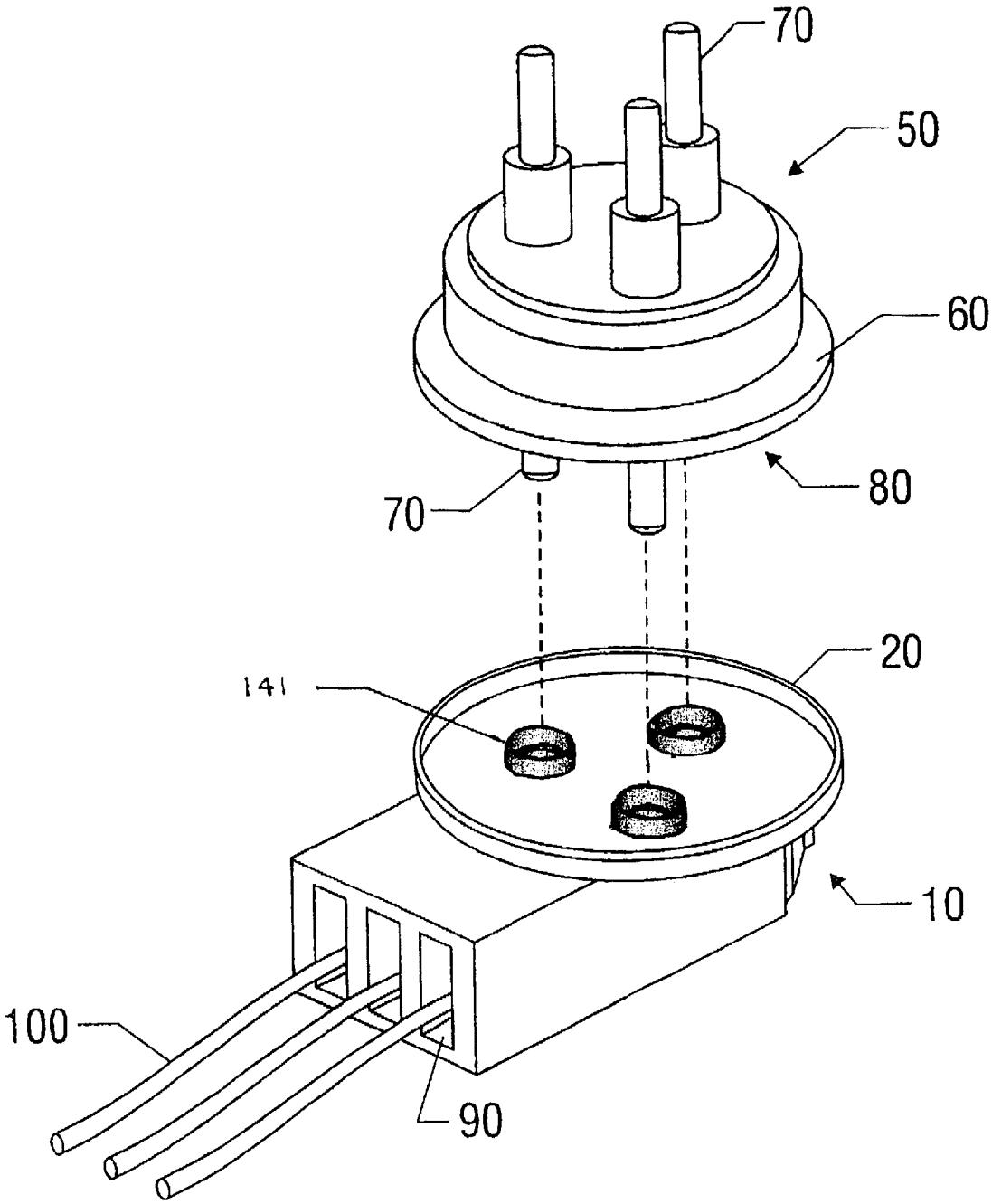
Figure 4:
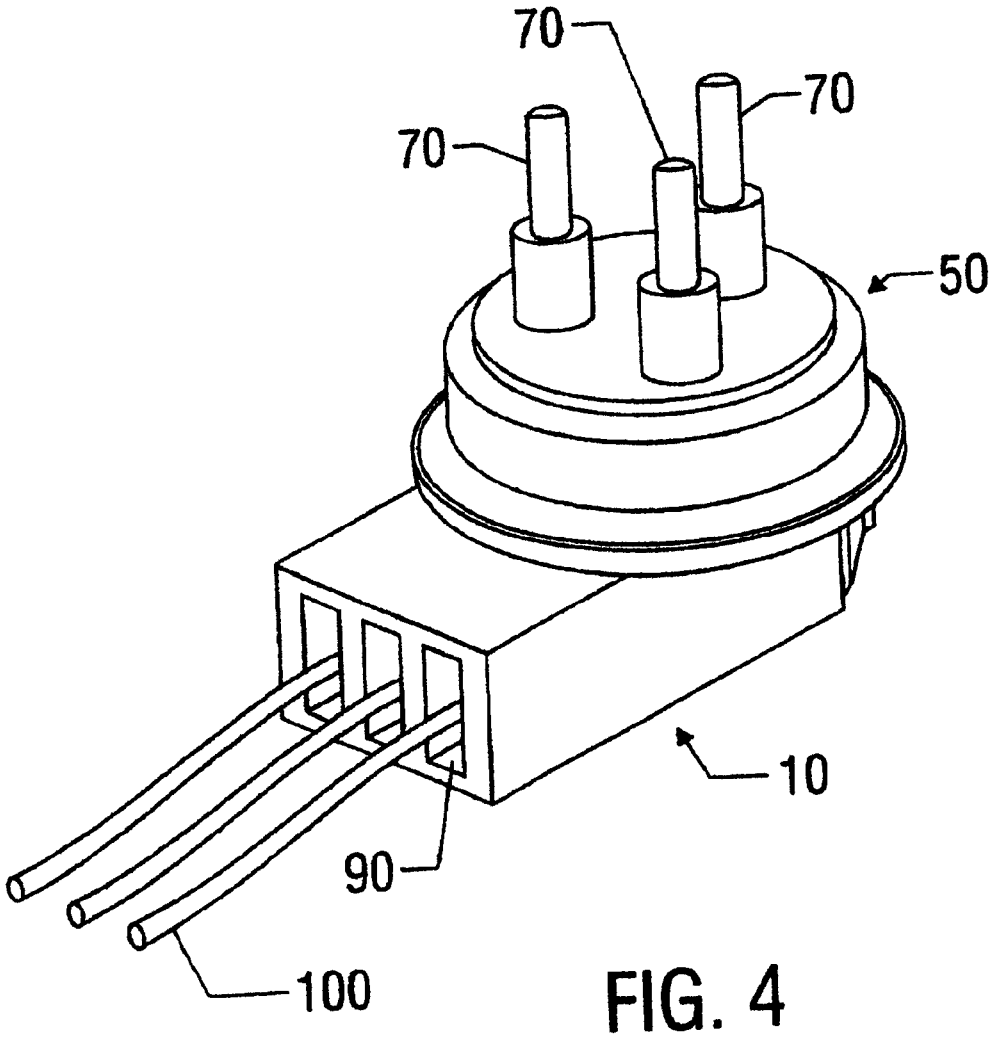
FIG. 4 illustrates a rear elevation view of the connector blocks illustrated in FIG. 2A and FIG. 2B, coupled with the terminal assembly.

The following description of embodiments in accordance with the present invention is directed to a connector block, which is adaptable to couple with a terminal assembly of a hermetically sealed compressor. Thus, specific details of the compressor, the terminal assembly, and the electrical connection between the motor and the terminal assembly are omitted. These structures are typical and well known in the compressor art. An example of a terminal assembly is shown in U.S. Pat. No. 5,580,282 which is fully incorporated herein by reference Turning to the figures, FIG. 1 illustrates a hermetically sealed compressor which includes a sealed metal chamber 110. A motor 120 connected to drive a compressor 130 are located within the sealed metal chamber 110. Power to the motor 120 is typically applied to the three electrical conductor pins 70, which will be discussed in detail later. An example of the applied power is a 220-volt, single-phase three-wire system. The terminal assembly 50, best shown in FIGS. 3A, 3B and 4, is welded to the sealed metal chamber 110.

Figure 2A:
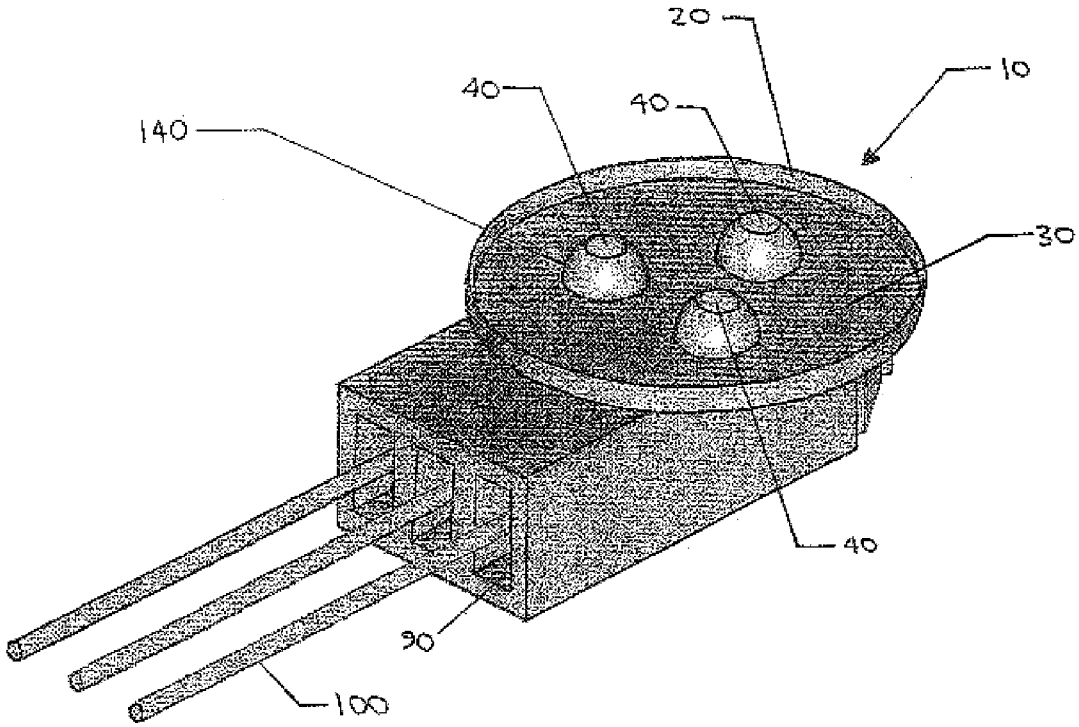
FIG. 2A and FIG. 2B are rear perspective views of connector blocks in accordance with exemplary embodiments of the present invention.

FIG. 2A illustrates a front perspective view of a connector block 10 for a hermetically sealed compressor in accordance with the present invention. As shown in FIG. 2A, the connector block 10 includes a substantially flat surface 30. FIG. 2A further illustrates three holes 40 in the center of the substantially flat surface 30. A connector wall or lip 20 is erected around the perimeter of the substantially flat surface 30. In this embodiment, the substantially flat surface 30 may have a circular construction. At least partially surrounding the circumference of at least one hole is a protrusion located on the substantially flat surface. As shown in FIG. 2A, there may be employed a protrusion 140 for each hole that fully surrounds the circumference of each hole 40 A protrusion 140 may take the form of a surface that is rounded and convex with respect to substantially flat surface 30. In one embodiment, the protrusion will have a height of about 0.125 to 0.128 inches above the substantially flat surface, and a radius of about 0.188 to 0.191 inches, such that the intersection between the protrusion and the substantially flat surface defines a circle having a diameter of about 0.362 to 0.367 inches.

Figure 2B:
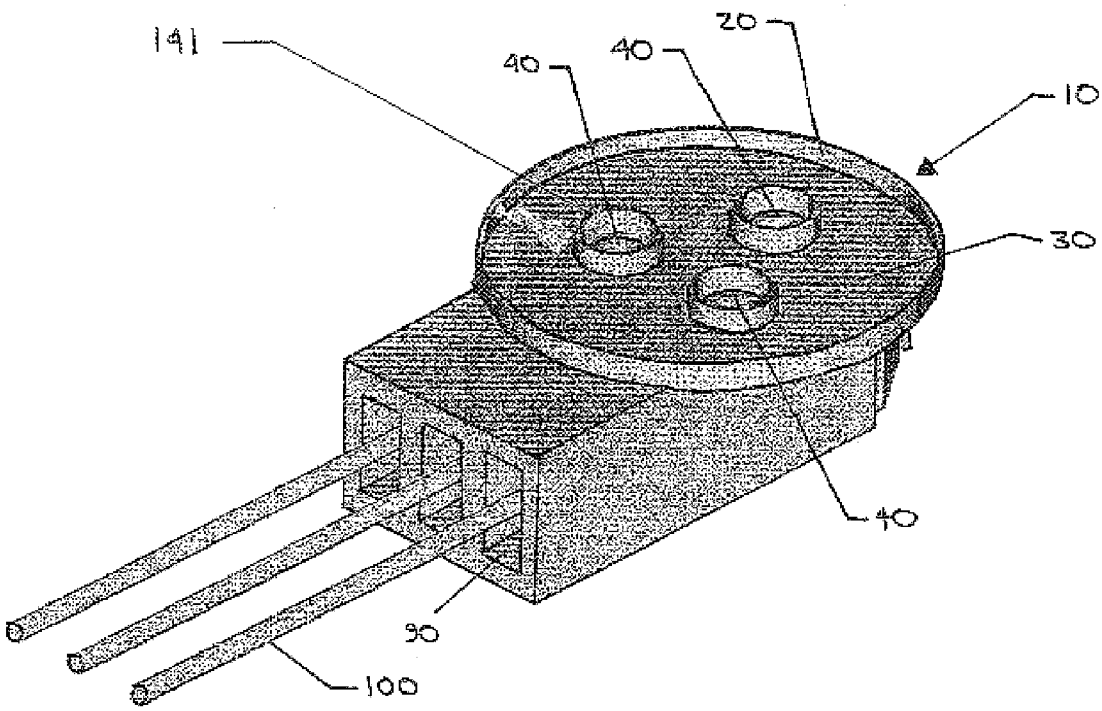

In another embodiment of the present invention, as shown in FIG. 2B, there may be employed a protrusion 141 that takes the form of a relatively thin cylindrical wall that fully surrounds the circumference of each hole. In one embodiment, the protrusion 141 will have a height of about 0.122 to 0.127 inches above the substantially flat surface. The protrusion may also have an inside diameter of about 0.160 inches, and an outside diameter of about 0.190 inches.

It will be understood by those of ordinary skill in the art with the benefit of this disclosure that other shapes for one or more protrusions may be employed. For example, a protrusion may take the form of a more conical, volcano-shaped structure having a relatively narrow top portion and a relatively broad base interfacing with the substantially flat surface. It will also be understood that one or more of the holes 40 of the connector block 10 may be key shaped, rather than circular. In this case, a protrusion of the present invention may accordingly be adapted to surround at least a portion of a key shaped hole. In one embodiment, the three holes 40 are equiangularly spaced from each other.

The connector block of the present invention is adapted to engage with a terminal assembly 50 as shown in FIGS. 3A and 3B. FIGS. 3A and 3B illustrate that the terminal assembly 50 may include a cap 60 and three electrical conductor pins 70, which are adaptable to mate with the three holes 40 in the center of the substantially flat surface 30 of the connector block 10. For that reason, the three holes 40 are spaced and aligned with the three electrical conductor pins 70. Each electrical conductor pin 70 is mounted through the cap 60 such that a portion of the conductor pin 70 is shown on each side of the cap 60. Each electrical conductor pin 70 is mounted inside the cap 60 by means of fused glass beads (not shown). The fused glass beads are sealed around the electrical conductor pins 70 and are sealed to the inside portion of the cap 60. It is to be understood that the shape and number of holes can be varied in accordance with the terminal assembly electrical conductor pins with which they are to be associated.

The connector lip 20, as shown in FIGS. 2A and 2B, is designed to engage with the open-end portion 80 of the terminal cap 60. When the connector block 10 engages with the terminal assembly 50, the connector lip 20 completely covers the terminal cap's open-end portion 80. In one embodiment, the connector lip 20 overlaps the terminal cap's open-end portion 80. In another embodiment, the connector lip 20 covers the entire terminal cap 60. Nevertheless, the terminal cap's open-end portion 80 is covered in such a way that the cap's open-end portion 80 is sealed by the lip 20. As the connector lip 20 seals the terminal cap's open-end portion 80, the lip 20 also surrounds the electrical conductor pins 70 that are mounted inside the terminal cap 60. As a result, the amount of particles or contaminants from the hermetically sealed compressor chamber that could enter into the terminal cap 60 is significantly reduced. Accordingly, the likelihood that an arc will jump from one electrical conductor pin to another pin or to other portions of the cap 60 where the contaminants have accumulated is thereby minimized.

In one embodiment, the inside diameter of the connector lip 20 is slightly larger than the outside diameter of the terminal cap's open-end portion 80. For example, the connector lip 20 may have a diameter of 1.322 inches. In another embodiment, the connector lip 20 has a height of 0.05 inch. In another embodiment, the connector lip 20 may have a diameter of about 1.290 to 1.310 inches, and a height of about 0.122 to 0.127 inches, or a height of about 0.125 to 0.128 inches. Moreover, the connector lip 20 may either be separable from the connector block 10 or integral with the connector block 10.

The connector block 10 may be formed using an injection molding technique. The connector block 10 may also be made from any one of a number of known plastic compounds having insulative properties. More specifically, the connector block 10 may be made from either ceramic, various polymeric materials, such as polypropylene, or anything that would be amenable to keeping the contaminants outside of the cap 60.

As shown in FIG. 3A, FIG. 3B and FIG. 4, the connector block 10 may also include three longitudinally extending separately spaced parallel passageways 90. These passageways 90 are designed to accommodate lead wires 100, which at one end are electrically connectable to the electrical conductor pins 70 through one end of the connector block 10, i.e., the three holes 40 in the center of the substantially flat surface 30. The other end of the lead wires 100 are electrically connectable to the motor 120 through the other end of the connector block 10. The lead wires 100 can be selected from any lead wires known in the electrical art.

Clips (not shown) are attached at the ends of the lead wires 100, which are connectable to the electrical conductor pins 70. The clips are aligned with those holes 40 so that when the connector block 10 is pushed upon the electrical conductor pins 70, the pins 70 will enter the clips and make electrical connection therewith and thereby connecting the motor 120 to the power supply (not shown) connected to the outside of the terminal assembly 50.

Figure 5A:
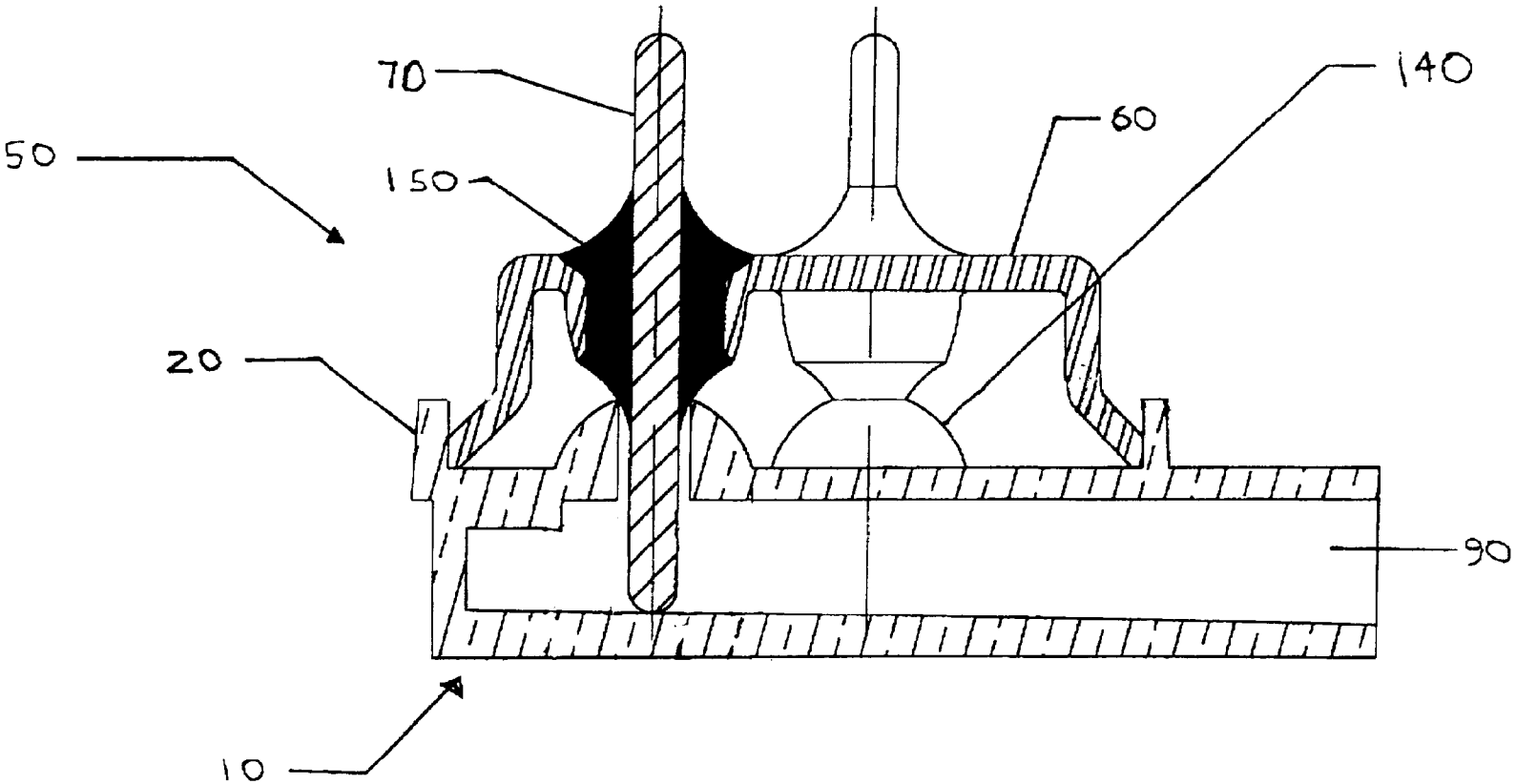
FIG. 5A and FIG. 5B are cross-sectional views of connector blocks in accordance with exemplary embodiments of the present invention.

FIG. 5A is a cross-sectional view of an exemplary connector block 10 according to the present invention, coupled with a terminal assembly 50. Protrusion 140 is rounded and convex with respect to the substantially flat surface of the connector block. Electrical conductor pins 70 are mechanically supported within cap 60 by fused glass 150. Protrusion 140 acts to shield at least a portion of the exposed portion of electrical pin 70. The top most portion of protrusion 140 may extend above the exposed portion of electrical pin 70, but it need not do so order to obtain the benefit of the present invention. In one embodiment, the top most portion of protrusion 140 may actually touch and seal against the fused glass 150 portion of the terminal assembly 50.

Figure 5B:
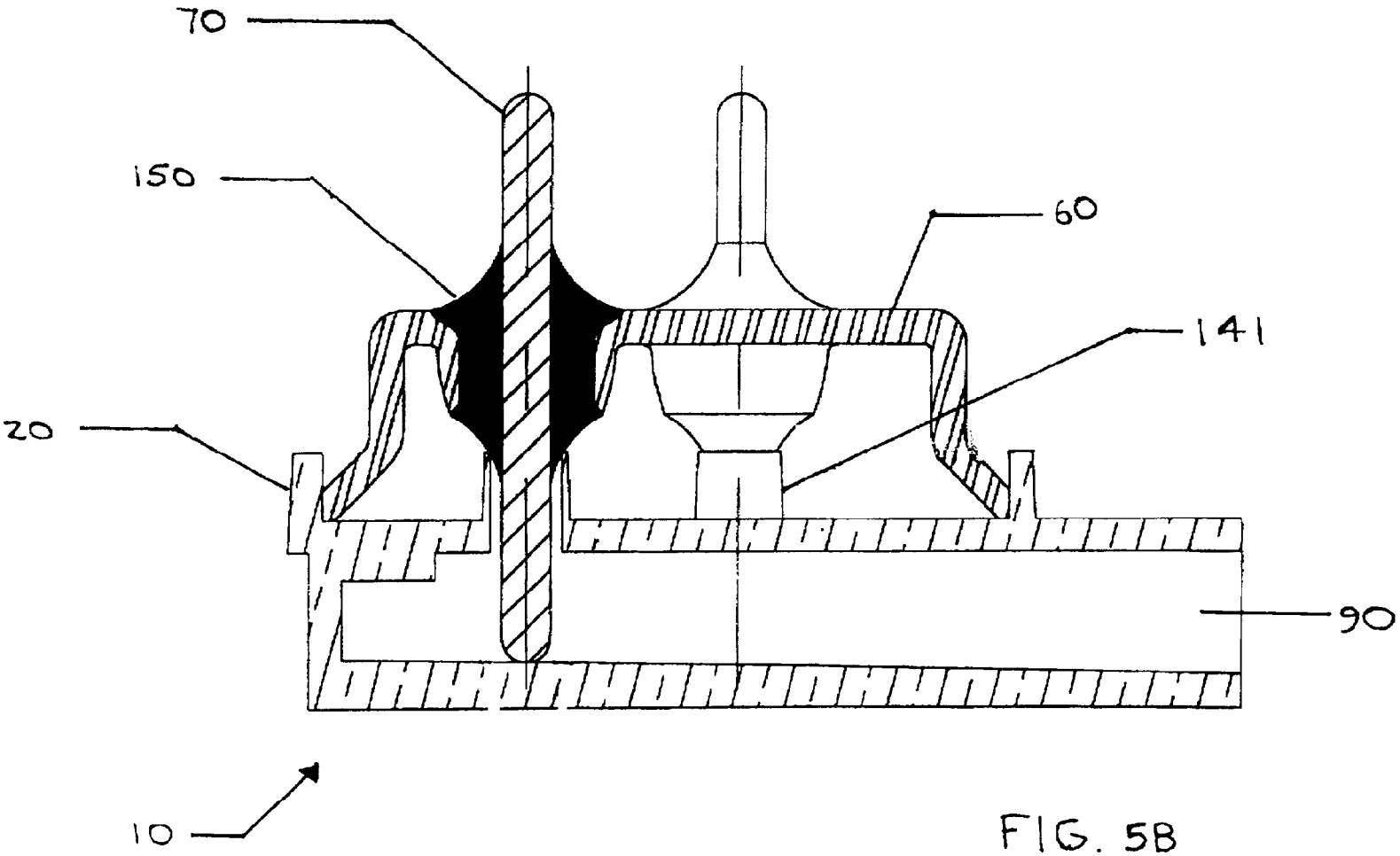

FIG. 5B is a cross-sectional view of another exemplary connector block 10 according to the present invention, coupled with a terminal assembly 50. In this exemplary connector block, protrusion 141 is a relatively thin cylindrical wall that fully surrounds the circumference of each hole. Similarly, protrusion 141 acts to shield at least a portion of the exposed portion of electrical pin 70. The top most portion of protrusion 141 may extend above the exposed portion of electrical pin 70, but it need not do so order to obtain the benefit of the present invention. In one embodiment, the top most portion of protrusion 141 may actually touch and seal against the fused glass 150 portion of the terminal assembly 50.

It is to be understood that the connector block in accordance of the present invention can be efficiently and effectively used to engage with other types of terminal assemblies or other pin configurations. It further is to be understood that the present invention is not limited for use only with three electrical conductor pins. Rather, it is adaptable for use with one, two or any number of electrical conductor pins.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above might be altered or modified and all such variations are considered within the scope and spirit of the invention.

What is claimed is:

1. A connector block engagable with a terminal assembly of a hermetically sealed compressor having a motor and a compressor mounted therein, wherein the terminal assembly comprises a cup-shaped body extending through and sealed along the peripheral rim thereof to an aperture in the wall of the hermetically sealed compressor, the cup-shaped body having an open end and a plurality of electrical conductor pins extending therefrom, the electrical conductor pins providing end portions which extend into the low pressure (suction) side of the hermetically sealed compressor, the connector block comprising:

a first open end defining a substantially flat surface including a plurality of holes adapted to receive the end portions of the plurality of electrical conductor pins when the connector block is engaged with the terminal assembly;

a connector lip extending around the perimeter of the substantially flat surface, wherein the connector lip is adapted to cover the open end of the cup-shaped body of the terminal assembly, to overlap at least a portion of an outer peripheral side wall of the cup-shaped body, and to surround the plurality of electrical conductor pins, such that at least of portion the pins are surrounded by both the lip and an inner peripheral side wall of the cup-shaped body, so as to minimize possible electrical arcing;

a protrusion extending from the substantially flat surface and at least partially surrounding the circumference of at least one of the holes; and a second open end defining a plurality of parallel passageways adapted to accommodate lead wires electrically connectable to the plurality of electrical conductor pins through the first open end of the connector block and electrically connectable to the motor through the second open end of the connector block; and wherein the connector block comprises insulative material.

2. The connector block of claim 1, wherein the protrusion fully surrounds the circumference of at least one of the holes.

3. The connector block of claim 2, wherein the protrusion comprises a lip adapted to surround a portion of one of the electrical conductor pins when the connector block is engaged with the terminal assembly.

4. The connector block of claim 2, wherein the protrusion comprises a surface that is convex relative to the substantially flat surface.

5. The connector block of claim 1, wherein the connector lip is adapted to seal the open end of the cup-shaped body of the terminal assembly such that the amount of contaminants from the hermetically sealed compressor that can enter into the cup-shaped body of the terminal assembly is significantly reduced.

6. The connector block of claim 1, wherein the connector lip defines an inside diameter that is larger than the outside diameter of the open end of the cup-shaped body.

7. The connector block of claim 1, wherein at least one of the connector lip and the protrusion is integrally connected to the connector block.

8. The connector block of claim 1, wherein the plurality of holes are equiangularly spaced.

9. A hermetically sealed compressor comprising:

a sealed metal chamber;

a compressor mounted within the sealed metal chamber;

a motor connected to the compressor to drive the compressor;

a terminal assembly electrically connected to the motor, the terminal assembly comprising a cup-shaped body extending through and sealed along the peripheral rim thereof to an aperture in the wall of the sealed metal chamber, the cup-shaped body having an open end and a plurality of electrical conductor pins extending from inside the cup-shaped body, the electrical conductor pins providing end portions which extend into the inside of the sealed metal chamber; and a connector block adapted to engage with the terminal assembly, wherein the connector block comprises: a substantially flat surface defining a plurality of holes adapted to receive the end portions of the plurality of electrical conductor pins when the connector block is engaged with the terminal assembly, wherein at least one of the holes is at least partially encircled by a protrusion located on the substantially flat surface, the substantially flat surface further defining a connector lip extended around the perimeter of the substantially flat surface, the connector lip adapted to overlap at least a portion of an outer peripheral side wall of the cup-shaped body, such that at least of portion of the pins are surrounded by both the lip and an inner peripheral side wall of the cup-shaped body.

10. The connector block of claim 9, wherein the protrusion fully encircles at least one of the holes.

11. The connector block of claim 10, wherein the protrusion comprises a lip adapted to encircle a portion of the plurality of an electrical conductor pin when the connector block is engaged with the terminal assembly.

12. The connector block of claim 10, wherein the protrusion comprises a rounded, convex surface.

13. The hermetically sealed compressor of claim 9, wherein the connector lip is adapted to cover the open end of the cup-shaped body of the terminal assembly and to surround the plurality of the electrical conductor pins when the connector block is engaged with the terminal assembly so as to minimize possible electrical arcing inside the cup-shaped body.

14. The hermetically sealed compressor of claim 9, wherein the substantially flat surface has a circular construction.

15. The hermetically sealed compressor of claim 9, wherein the connector lip defines an inside diameter that is larger than the outside diameter of the open end of the cup-shaped body.

16. The hermetically sealed compressor of claim 9, wherein the connector lip and protrusion are integrally connected to the connector block.

17. A method of minimizing electrical arcing inside a cup-shaped body of a terminal assembly of a hermetically sealed compressor during operation of the compressor, wherein the cup-shaped body extends through and is sealed along the peripheral rim thereof to an aperture in the wall of the hermetically sealed compressor, the method comprising:

mounting a plurality of electrical conductor pins inside an open end of the cup-shaped body of the terminal assembly, the electrical conductor pins providing end portions which extend into the inside of the compressor;

providing a connector block adapted to couple with the terminal assembly, wherein the connector block defines a substantially flat surface on one side of the connector block, the substantially flat surface being adapted to engage with the open end of the cup-shaped body of the terminal assembly, wherein the substantially flat surface defines a plurality of holes adapted to accommodate the end portions of the plurality of electrical conductor pins, at least one of the holes at least partially circumscribed by a protrusion located on the substantially flat surface, and wherein the substantially flat surface further defines a connector lip around the perimeter of the substantially flat surface; and coupling the terminal assembly with the connector block such that the connector lip overlaps and covers the open end of the cup-shaped body of the terminal assembly, the connector lip adapted to overlap at least a portion of an outer peripheral side wall of the cup-shaped body, such that at least of portion of the pins are surrounded by the lip, by an inner peripheral side wall of the cup-shaped body, and by a protrusion.

18. A connector block adapted to engage with a terminal assembly of a hermetically sealed compressor having a motor and a compressor mounted therein, wherein the terminal assembly defines a cap having an open end and a plurality of electrical conductor pins extending therefrom, the connector block comprising:

a first open end;

wherein the first open end defines a substantially flat surface; and wherein the substantially flat surface defines a plurality of holes adapted to receive the plurality of electrical conductor pins when the connector block is engaged with the terminal assembly, wherein there is employed a protrusion located on the substantially flat surface, the protrusion at least partially surrounding the circumference of at least one of the holes, and wherein the substantially flat surface further defines a connector lip extending around the perimeter of the substantially flat surface.

19. The connector block of claim 18, wherein the protrusion fully surrounds the circumference of at least one of the holes.

20. The connector block of claim 19, wherein the protrusion comprises a lip adapted to surround a portion of an electrical conductor pin when the connector block is engaged with the terminal assembly.

21. The connector block of claim 19, wherein the protrusion comprises a surface that is convex relative to the substantially flat surface.

22. The connector block of claim 18, wherein the connector lip is adapted to seal the open end of the cap of the terminal assembly such that the amount of contaminants from the operation of the hermetically sealed compressor that could enter into the cap of the terminal assembly is greatly minimized.

23. The connector block of claim 18, wherein the connector lip is adapted to cover the open end of the cap of the terminal assembly.

24. The connector block of claim 18, wherein the connector lip is adapted to surround the plurality of electrical conductor pins.

25. The connector block of claim 18, wherein the substantially flat surface has a circular construction.

26. The connector block of claim 18, wherein the plurality of holes are equiangularly spaced.

27. The connector block of claim 18, further comprising a second open end, wherein the second open end defines a plurality of parallel passageways adapted to accommodate lead wires.

28. The connector block of claim 18, wherein the lead wires are electrically connectable to the plurality of electrical conductor pins through the first open end of the connector block and electrically connectable to the motor through the second open end of the connector block.

29. The connector block of claim 17, wherein the connector block comprises insulative material.

30. A connector block adapted to engage with a terminal assembly of a hermetically sealed compressor having a motor and a compressor mounted therein, wherein the terminal assembly defines a cap having an open end and a plurality of electrical conductor pins extending therefrom, the connector block comprising:

an open end;

wherein the open end defines a substantially flat surface; and wherein the substantially flat surface defines means for receiving the plurality of electrical conductor pins when the connector block is engaged with the terminal assembly, wherein the substantially flat surface further defines means for circumscribing the receiving means, and wherein the substantially flat surface further defines means for covering the open end of the cap of the terminal assembly.

31. An assembly for use in a hermetically sealed compressor, the assembly comprising:

a terminal assembly comprising a cup-shaped body adapted to extend through and be sealed along its peripheral rim to an aperture in a wall of the hermetically sealed compressor, the cup-shaped body having an open end and a plurality of electrical conductor pins extending therefrom, the electrical conductor pins providing end portions which extend into a low pressure (suction) side of the hermetically sealed compressor; and a connector block comprising (i) a first open end defining a substantially flat surface including a plurality of holes adapted to receive the end portions of the plurality of electrical conductor pins; (ii) a connector lip extending around the perimeter of the substantially flat surface, wherein the connector lip is adapted to cover the open end of the cup-shaped body of the terminal assembly, to overlap at least a portion of an outer peripheral side wall of the cup-shaped body, and to surround the plurality of electrical conductor pins, such that at least of portion of the pins are surrounded by both the lip and an inner peripheral side wall of the cup-shaped body; (iii) a protrusion extending from the substantially flat surface and at least partially surrounding the circumference of at least one of the holes; (iv) a second open end defining a plurality of parallel passageways adapted to accommodate lead wires electrically connectable to the plurality of electrical conductor pins through the first open end of the connector block and electrically connectable to a motor within the hermetically sealed compressor through the second open end of the connector block.

32. The assembly of claim 31, wherein the protrusion fully surrounds the circumference of at least one of the holes.

33. The assembly of claim 32, wherein the protrusion comprises a lip adapted to surround a portion of an electrical conductor pin when the connector block is engaged with the terminal assembly.

34. The assembly of claim 32, wherein the protrusion comprises a surface that is convex relative to the substantially flat surface.

35. The assembly of claim 31, wherein the connector lip defines an inside diameter that is larger than the outside diameter of the open end of the cup-shaped body.

36. The assembly of claim 31, wherein at least one of the connector lip and the protrusion is integrally connected to the connector block.

* * * * *